United States Patent [19]

Celaschi et al.

[11] Patent Number: 4,915,244

[45] Date of Patent: Apr. 10, 1990

[54] ONE-PIECE BOTTLE TOP WITH DEFORMABLE BREAK-OPEN SEAL

[75] Inventors: Giovanni Celaschi, Parma; Emilio Morini, Colorno, both of Italy

[73] Assignee: Bormioli Metalplast, S.p.A., Parma, Italy

[21] Appl. No.: 334,899

[22] Filed: Apr. 7, 1989

[30] Foreign Application Priority Data

Apr. 13, 1988 [IT] Italy ..... 40058 A/88

[51] Int. Cl.[4] ..... B65D 41/34

[52] U.S. Cl. ..... 215/252

[58] Field of Search ..... 215/252

[56] References Cited

U.S. PATENT DOCUMENTS 3,235,115 2/1966 Duke ..... 215/252
3,329,295 7/1967 Fields ..... 215/252
4,485,934 12/1984 Maguire ..... 215/252
4,592,476 6/1986 Yasada ..... 215/252
4,741,447 5/1988 John ..... 215/252
4,771,904 9/1988 Perne et al. ..... 215/252

*Primary Examiner*—Donald F. Norton
*Attorney, Agent, or Firm*—Laff, Whitesel, Conte & Saret

[57] ABSTRACT

The one-piece twist-off bottle top, used mainly for fizzy or still soft drinks, has a deformable break-open seal (2) that features a succession of recesses (4) exhibiting oblique pyramidal shape. When the top is fitted initially to the bottle, certain of the surfaces of these pyramids are urged gently outward so that the internal diameter of the seal can be enlarged; when the cap is first twisted off, other surfaces are designed to resist on coming up against an annular bead (9) offered by the neck of the bottle, in such a way that the cap and seal are forced to separate.

8 Claims, 2 Drawing Sheets

Fig. 1
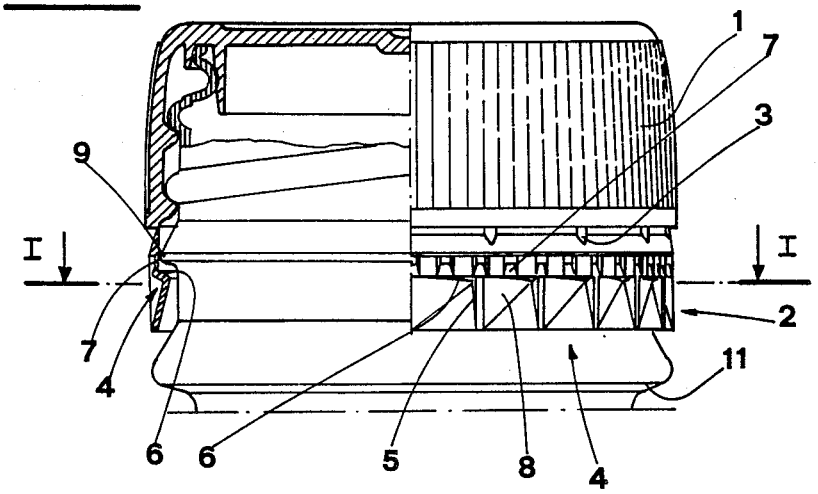
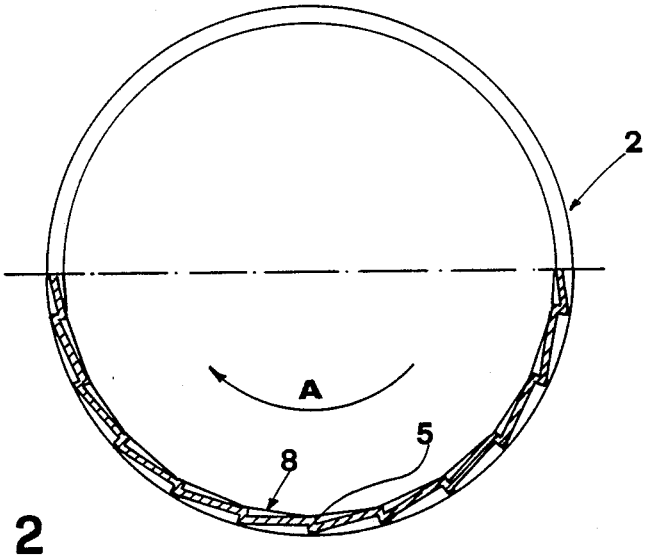
Fig. 2

ONE-PIECE BOTTLE TOP WITH DEFORMABLE BREAK-OPEN SEAL

BACKGROUND OF THE INVENTION

The invention relates to a one-piece bottle top with a deformable break-open seal.

The prior art has long embraced bottle tops molded in one piece, mostly in plastic material; such tops consist in a cap, generally a screw type, the bottom edge of which is connected by way of easily broken fillets with an annular seal that becomes separated at the moment when the bottle is first opened.

Tops of the type in question are fitted by being forced over and screwed onto the neck of the bottle, and are almost invariably provided with one or more inwardly-projecting elements located in such a way as to interfere with an annular bead offered by the bottle neck, thus bringing about the separation of the break-open seal when the cap is first twisted off to open the bottle.

Problems besetting manufacture of these bottle tops are connected essentially with the feasibility of their embodiment by molding, and in particular, with the difficulty of removing the formed article from the mold without damaging its break-open seal; similarly, the top must be fashioned in such a way as to enable easy fitment to the neck of the bottle, and to ensure that the cap part cannot be unscrewed unless the seal has first been broken.

One conventional top is provided with a break-open seal incorporating an inwardly-projecting element in the form of an annular rim. Such a rim is prevented from projecting too far, in view of the removal of the top from the mold and its subsequent forced fitment to the neck of the bottle; at the same time, the projection must ensure a degree of interference with the neck sufficient to produce an effortless separation of the seal when the cap is twisted off.

The defects commonly encountered with this design of top are traceable to variations in the dimensions of the bottle neck: if large, it becomes difficult to force the rim over the bead; if small, the cap will unscrew too easily, the seal fails to break open, and the entire top separates from the bottle. Other designs feature tongues or similar expedients, located internally of the seal, that flex when the top is fitted to the bottle initially, and function as interference elements when the cap is unscrewed; given the necessarily high degree of flexibility of such elements, this type of top also betrays the drawback that the cap can sometimes be twisted off without the seal breaking open.

The object of the invention is to overcome the drawbacks mentioned above, by providing a bottle top that is readily removable from the mold, easily fitted to the neck of a bottle utilizing automatic machinery, and which incorporates a break-open seal that is guaranteed to separate when the cap is first twisted off.

One advantage of the bottle top according to the invention is that, whilst evidently suitable for fitment to a bottle with a specially designed neck, it can also be used with bottles having a standard type neck profile such as those fashioned in plastic or glass commonly used for soft drinks, carbonated or otherwise.

A further advantage of the bottle top disclosed is that it will function correctly even though fitted to a bottle neck exhibiting dimensions that depart from a nominal specification, provided that such a departure falls within a given range of dimensional tolerances.

SUMMARY OF THE INVENTION

The stated objects and advantages are realized, and others besides, with the bottle top according to the invention, which is of the type comprising a screw cap the bottom edge of which connects by way of easily broken fillets with an annular break-open seal; an essential feature of the top disclosed is that the lateral surface of the annular seal appears as a plurality of recesses each exhibiting the shape of an oblique pyramid in which the axis connecting the vertex and the center of the base is angled in the direction of the join between seal and cap.

BRIEF DESCRIPTION OF THE DRAWINGS

Two preferred embodiments of the invention will now be described, by way of example, with the aid of the accompanying drawings, in which:

FIG. 1 is a vertical elevation of a first embodiment of the bottle top disclosed, fitted to the neck of a bottle, which is viewed with certain parts omitted and others seen in section;

FIG. 2 shows part of the section through I—I FIG. 1;

DESCRIPTION OF THE PREFERRED EMBODIMENTS

Figure 3:
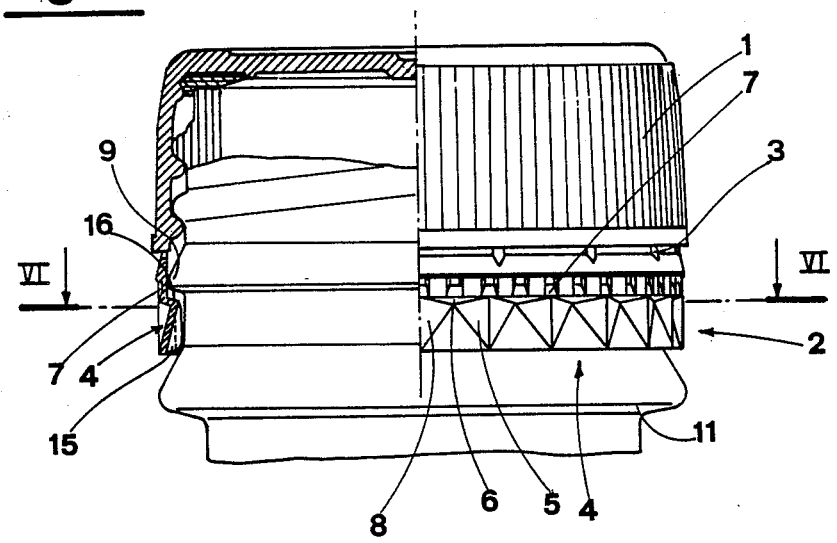
FIG. 3 is a vertical elevation of a second embodiment of the bottle top disclosed, fitted to the neck of a bottle, which is viewed with certain parts omitted and others seen in section.

Referring to the drawings, 1 denotes a twist-off cap of the kind conventionally used for bottle tops of the type in question; the top part of the cap incorporates a sealing element, which in FIG. 1 appears a stopper insertable in the neck 11 of the bottle, but might be of any given embodiment, such as the washer type expedient illustrated in FIG. 3, applied in resilient or fluid material, or directly incorporated into the mold of the cap.

2 denotes a consumer protective seal of annular shape, which is connected to the bottom edge of the cap 1 by way of easily broken fillets 3.

The lateral surface of the seal 2 incorporates a plurality of single recesses 4 exhibiting the shape of an oblique, rectangular-base pyramid. In the embodiment of FIGS. 1 and 2, the axis that joins the vertex of the pyramid with the center of its base is angled concurrent both with the direction in which the cap is twisted off, and toward the join between seal and cap. In short, the vertex of the pyramid is offset upwardly and to the right in relation to the center of the base, as viewed in FIG. 1.

More exactly, the position of the vertex is such, that the pyramidal face 5 issuing from the side of the base aligned with the edge of the cap and located at rear, viewed in relation to the direction in which the cap is screwed on, lies substantially perpendicular to the base plane of the recess 4, whereas the face 6 issuing from the side of the base located uppermost and flanking the join between the seal and the cap, is inclined at an angle of between 5° and 20° in relation to the same base plane.

Figure 4:
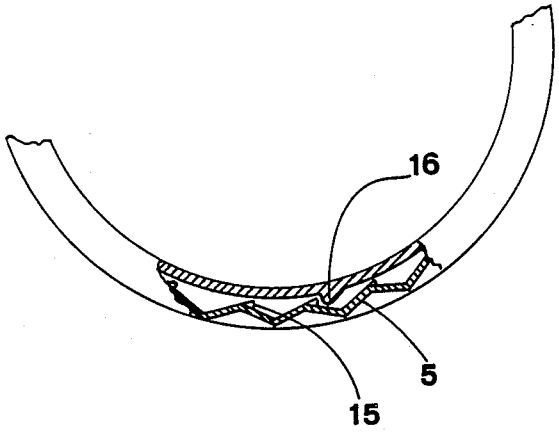
FIG. 4 shows part of the section through VI—IV FIG. 3, viewed in enlarged scale.

In the embodiment of FIGS. 3 and 4, the axis joining the vertex of the pyramid with the center of the base is angled toward the area of the connection between seal and cap, that is to say, angled upwards in relation to the center of the base of the pyramid as viewed in FIG. 3.

The uppermost face 6 once again is angled at between 5° and 20° with respect to the base plane of the recess, though the face denoted 5 in this embodiment no longer lies near-perpendicular to the base, but instead, is angled in the direction in which the cap screws on.

This second embodiment also features a plurality of tongues 15, each extending inward from the vertex of a respective pyramidal recess 4, the purpose of which will shortly become clear.

The two sides of the base of each recess 4 that lie concurrent with the edge of the cap 1 measure between 3 and 7mm in length (0.125–0.275") whilst the remaining sides are between 4 and 8mm (0.150–0.300"); in the examples shown in the drawings, the base of the single recess 4 measures 5×6mm (0.200–0250"). The height of the pyramid, i.e. the depth of the recess, will be between 0.1 and 2mm, and in the examples illustrated measures 1mm (0.040") approx.

The single recesses 4 are distributed along the seal spaced apart at regular intervals, the distance between adjacent recesses being approximately equal to the thickness of the seal.

7 denotes one of a set of notches occupying the part of the seal 2 lying between the recesses 4 and the fillets 3, the purpose of which will shortly become clear.

9 denotes an annular bead issuing from the neck 11 of the bottle; in the embodiment of FIGS. 3 and 4, the bottle neck also incorporates a plurality of projections 16 that work in conjunction with the aforementioned tongues 15 to the end of inhibiting rotation of the seal 2 when the cap is twisted off.

Once the bottle top has been formed, its removal from the mold involves freeing the interference projection created by the top angled faces 6 of the pyramidal recesses 4. Accordingly, suitable needles are inserted into the notches 7, which balance the mechanical stresses produced by the operation; were such needles not to be used, stresses of this order would simply strain the fillets 3 and cause them to break. The gently angled embodiment of the faces 6 is instrumental in favoring removal of the formed top from the mold; without the angled surfaces, in fact, the removal operation would be complicated considerably.

The operation of forcing the top over the neck of the bottle is accomplished by applying downward pressure and twisting in the direction indicated by the arrow A of FIG. 2, the result being that the annular bead 9 offered by the bottle neck registers with the pyramid profiles, urging against the faces denoted 8, and the recesses themselves are deformed to the extent that the diameter of the imaginary circle interconnecting their vertices is enlarged; it is this elastic deformation that enables initial fitment of the top to the bottle.

When the cap 1 is twisted off, the uppermost face 6 of the recess impinges on the annular bead 9. It is an essential feature of the invention that the profile of the recess renders the seal 2 far more rigid in the face of a stress directed downward from above, than when encountering a stress directed from left to right (as viewed in FIGS. 2 and 4), such as that generated when the top is fitted initially to the bottle; thus, the pyramid does not deform when the cap is twisted off, and the stress on the top angled faces 6 is transmitted to the fillets 3, which break accordingly.

Both embodiments of the top disclosed will function equally well either with bottles having a standard type neck, or with bottles having a neck exhibiting projections 16 as illustrated in FIGS. 3 and 4. These projections not only serve to prevent the seal 2 from rotating when the cap is twisted off; they also ensure a more decisive break of the fillets 3 by interfering positively with the face of the pyramid denoted 5, in the case of the embodiment of FIGS. 1 and 2, or with the tongues 15 in the case of the embodiment illustrated in FIGS. 3 and 4.

What is claimed:

1. A one-piece bottle top with a deformable break-open seal, comprising a screw cap (1), the bottom edge of which is connected by way of easily broken fillets (3) with an annular break-open seal (2) the lateral surface of which appears as a plurality of recesses (4) each exhibiting the shape of an oblique pyramid disposed with the axis connecting its vertex and the center of its base angled in the direction of the join between the seal (2) and the cap (1).

2. A bottle top as in claim 1, wherein the oblique pyramid shape of each recess (4) has a rectangular base, and the face (6) issuing from the side of the base located uppermost and flanking the joint between the seal (2) and the cap (1) is inclined at an angle of between 5° and 20° in relation to the base plane of the recess.

3. A bottle top as in claim 2, wherein the length of the two sides of the base of each recess (4) that lie concurrent with an edge of the cap is between 3 and 7mm (0.125–0.275"), the length of the remaining sides is between 4 and 8mm (0.150–0.300"), and the height of the pyramid through the perpendicular from base to vertex is between 0.1 and 2mm (0.033–0.080").

4. A bottle top as in claim 2, wherein each recess (4) exhibits a tongue (15) associated with the vertex of the pyramid and extending inward from the seal.

5. A bottle top as sin claim 1, wherein: the oblique pyramid shape of each recess (4) has a rectangular base; the axis joining the vertex of the pyramid with the center of its base is angled in the direction in which the cap is twisted off; the face (5) issuing from the side of the base aligned with an edge of the cap and located at rear, viewed in relation to the direction in which the cap is screwed on, lies substantially perpendicular to the base plane of the recess; and the face (6) issuing from the side of the base located uppermost and flanking the joint between the seal (2) and the cap (1), is inclined at an angle of between 5° and 20° in relation to the base plane of the recess.

6. A bottle top as in claim 5, wherein the length of the two sides of the base of each recess (4) that lie concurrent with the edge of the cap is between 3 and 7mm (0.125–0.275"), the length of the remaining sides is between 4 and 8mm (0.150–0.300"), and the height of the pyramid through the perpendicular from base to vertex is between 0.1 and 2mm (0.033–0.080").

7. A bottle top as in claim 1, wherein the recesses (4) are distributed along the seal (2) spaced apart at regular intervals, the distance between adjacent recesses approximately equal to the thickness of the seal.

8. A bottle top as in claim 1, wherein the seal further comprises a plurality of notches (7) distributed circumferentially between the recesses (4) and the break-open fillets (3).

* * * * *